US008774691B2

(12) United States Patent
Yamada et al.

(10) Patent No.: US 8,774,691 B2
(45) Date of Patent: Jul. 8, 2014

(54) IMAGE FORMING APPARATUS, FIXING DEVICE, AND FIXING METHOD

(75) Inventors: Shintaroh Yamada, Kawasaki (JP); Hidehiko Fujiwara, Tokyo (JP); Kazunori Bannai, Atsugi (JP); Manabu Nonaka, Chigasaki (JP)

(73) Assignee: Ricoh Company, Limited, Tokyo (JP)

( * ) Notice: Subject to any disclaimer, the term of this patent is extended or adjusted under 35 U.S.C. 154(b) by 857 days.

(21) Appl. No.: 12/169,217

(22) Filed: Jul. 8, 2008

(65) Prior Publication Data

US 2009/0016792 A1 Jan. 15, 2009

(30) Foreign Application Priority Data

Jul. 10, 2007 (JP) ..... 2007-180759

(51) Int. Cl.
*G03G 15/20* (2006.01)

(52) U.S. Cl.
USPC ..... 399/329; 399/320; 219/469

(58) Field of Classification Search
USPC ..... 219/469–471; 399/320, 328–331
See application file for complete search history.

(56) References Cited

U.S. PATENT DOCUMENTS

| | | | | |
|---|---|---|---|---|
| 5,774,763 | A * | 6/1998 | Muramatsu | 399/69 |
| 6,151,466 | A | 11/2000 | Fujiwara et al. | |
| 6,449,457 | B2 * | 9/2002 | Samei et al. | 399/328 |
| 6,542,712 | B2 | 4/2003 | Kamijo et al. | |
| 6,658,222 | B2 | 12/2003 | Kamijo et al. | |
| 6,731,900 | B2 | 5/2004 | Takenaka et al. | |
| 6,731,902 | B2 | 5/2004 | Takenaka et al. | |
| 6,788,916 | B2 | 9/2004 | Takenaka et al. | |
| 6,801,744 | B2 | 10/2004 | Fujiwara et al. | |
| 6,907,218 | B2 | 6/2005 | Fujiwara et al. | |
| 6,915,099 | B2 * | 7/2005 | Izawa et al. | 399/328 |
| 2003/0160039 | A1 * | 8/2003 | Eskey | 219/216 |
| 2004/0218949 | A1 * | 11/2004 | Fukuzawa et al. | 399/328 |
| 2007/0059060 | A1 * | 3/2007 | Kameda et al. | 399/329 |
| 2007/0189818 | A1 * | 8/2007 | Kondo et al. | 399/329 |
| 2008/0012208 | A1 | 1/2008 | Fujiwara et al. | |
| 2008/0124152 | A1 | 5/2008 | Nishikawa et al. | |

FOREIGN PATENT DOCUMENTS

| | | | |
|---|---|---|---|
| JP | 56006278 | A * | 1/1981 |
| JP | 2642212 | | 5/1997 |
| JP | 2001-222173 | | 8/2001 |
| JP | 2002-6656 | | 1/2002 |
| JP | 2004-198448 | | 7/2004 |

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustsdt, L.L.P.

(57) ABSTRACT

An image forming apparatus includes an image forming mechanism for forming a toner image on a recording medium, and a fixing device for fixing the toner image on the recording medium. The fixing device including a fixing film, a pressure member, a contact member, a heating device, a holding member, and at least one of a low friction member and a thermal conductivity improving member provided between the fixing film and the contact member. The fixing film heated by the heating device via the contact member comes into contact with the recording medium. The pressure member comes into pressure contact with the fixing film. The contact member comes into pressure contact with the pressure member via the fixing film to form, between the fixing film and the pressure member, a nip portion through which the recording medium is passed. The holding member holds the contact member and the heating device.

19 Claims, 6 Drawing Sheets

IMAGE FORMING APPARATUS, FIXING DEVICE, AND FIXING METHOD

CROSS-REFERENCE TO RELATED APPLICATIONS

This application claims priority to Japanese Patent Application No. 2007-180759 filed on Jul. 10, 2007, the entire contents of which are hereby incorporated by reference herein.

BACKGROUND OF THE INVENTION

1. Field of the Invention

The present invention relates to an image forming apparatus such as a copier, a printer, a facsimile machine, and a multifunctional machine having functions of at least two of the above machines, and a fixing device installed in the image forming apparatus.

2. Discussion of the Background Art

In background image forming apparatuses such as a copier and a printer, an on-demand-type fixing device having a relatively short rise time is widely used.

The on-demand-type fixing device is constituted by an endless fixing film serving as a fixing film, a pressure roller serving as a pressure member, a heater such as a ceramic heater serving as a heating device, and so forth. The heater, which is provided on the inner side of the fixing film and comes into contact with the pressure roller via the fixing film to form a nip portion thereat, heats the fixing film. At the nip portion, a toner image formed on a recording medium conveyed to the nip portion is subjected to heat and pressure and fixed on the recording medium.

The on-demand system involves issues of friction generated between the fixing film and the member in contact with the fixing film (i.e., the heater serving as the heating device in the above example), and improvement of the heating efficiency in heating the fixing film by the heater. There are background techniques addressing the issues.

In a fixing device according to one of the background techniques, the coefficient of friction between a drive roller and a fixing film is set to be greater than the coefficient of friction between another roller and the fixing film. Accordingly, the fixing film can slidingly move smoothly in accordance with the rotation of the drive roller.

In a fixing device according to another one of the background techniques, at least one of the most upstream end portion and the most downstream end portion of a heating member in the moving direction of a fixing film is bent. Accordingly, it is possible to prevent an edge portion of the heating member from coming into contact with the fixing film and deforming a substantially completely circular shape of the movement locus of the fixing film, and to prevent an increase in rotational resistance of the fixing film.

In a fixing device according to another one of the background techniques, a surface of a heating member that comes into contact with and slidingly moves on a fixing film is coated with or includes a fluororesin. Accordingly, the contact resistance of the fixing film is reduced.

In the background on-demand-type fixing devices described above, however, replacement servicing, i.e., maintenance of the heating device such as the heater is a problem, as described in detail below.

Specifically, the life of the heater is limited. In the fixing device, therefore, maintenance to replace the heater with a new one is often performed. However, the heater is in pressure contact with the pressure roller via the fixing film, and thus it is difficult to pull out the pressure-applied heater in the width direction, i.e., the longitudinal direction thereof.

It is conceivable to provide a mechanism for releasing the pressure acting between the heater, the fixing film, and the pressure roller. That is, the heater can be removed from the fixing device after the pressure acting between the heater and the pressure roller is released by the operation of the pressure release mechanism. In this case, however, extra cost and space are required to provide the pressure release mechanism.

In particular, according to the configuration of the background on-demand type fixing devices, the heater is constantly pressed by the pressure member, and thus is likely to be damaged in an unjamming process, during shipment of the devices, and so forth. Therefore, the above issue of the constantly applied pressure is not negligible.

Further, in the background on-demand-type fixing devices described above, the heater is in contact with the fixing film. Therefore, if the fixing devices are provided with a member for reducing the coefficient of friction between the heater and the fixing film or for improving the thermal conductivity, some measure is required that prevents the characteristics of the heater such as the heating efficiency and the safety of the heater from being directly affected by the addition of such a member.

SUMMARY OF THE INVENTION

This patent specification describes an image forming apparatus. In one example, an image forming apparatus includes an image forming mechanism for forming a toner image on a recording medium, and a fixing device for fixing the toner image on the recording medium. The fixing device includes a fixing film, a pressure member, a contact member, a heating device, a holding member, and at least one of a low friction member and a thermal conductivity improving member. The fixing film comes into contact with the recording medium. The pressure member comes into pressure contact with the fixing film. The contact member comes into pressure contact with the pressure member via the fixing film to form, between the fixing film and the pressure member, a nip portion through which the recording medium is passed. The heating device heats the fixing film via the contact member. The holding member holds the contact member and the heating device. At least one of the low friction member and the thermal conductivity improving member is provided between the fixing film and the contact member.

This patent specification further describes a fixing device for fixing a toner image on a recording medium. In one example, a fixing device includes a fixing film, a pressure member, a contact member, a heating device, a holding member, and at least one of a low friction member and a thermal conductivity improving member. The fixing film comes into contact with the recording medium. The pressure member comes into pressure contact with the fixing film. The contact member comes into pressure contact with the pressure member via the fixing film to form, between the fixing film and the pressure member, a nip portion through which the recording medium is passed. The heating device heats the fixing film via the contact member. The holding member holds the contact member and the heating device. At least one of the low friction member and the thermal conductivity improving member is provided between the fixing film and the contact member.

This patent specification further describes another fixing device for fixing a toner image on a recording medium. In one example, another fixing device includes fixing means, pressure means, contact means, heating means, holding means, and at least one of friction reducing means and thermal conductivity improving means. The fixing means comes into contact with the recording medium to fix the toner image thereon. The pressure means comes into pressure contact with the fixing film. The contact means comes into pressure contact with the pressure means via the fixing means to form, between the fixing means and the pressure means, a nip portion through which the recording medium is passed. The heating means heats the fixing means via the contact means. The holding means holds the contact means and the heating means. The friction reducing means reduces friction between the fixing means and the contact means. The thermal conductivity improving means improves the thermal conductivity from the contact means to the fixing means.

Further, this patent specification describes a method of fixing a toner image on a recording medium. The method includes providing at least one of a low friction member and a thermal conductivity improving member between a fixing film and a contact member, heating the fixing film via the contact member, and providing pressure to contact the contact member with the fixing film to fix the toner image.

BRIEF DESCRIPTION OF THE DRAWINGS

A more complete appreciation of the invention and many of the advantages thereof is obtained as the same becomes better understood by reference to the following detailed description when considered in connection with the accompanying drawings, wherein.

DETAILED DESCRIPTION OF THE INVENTION

Figure 1:
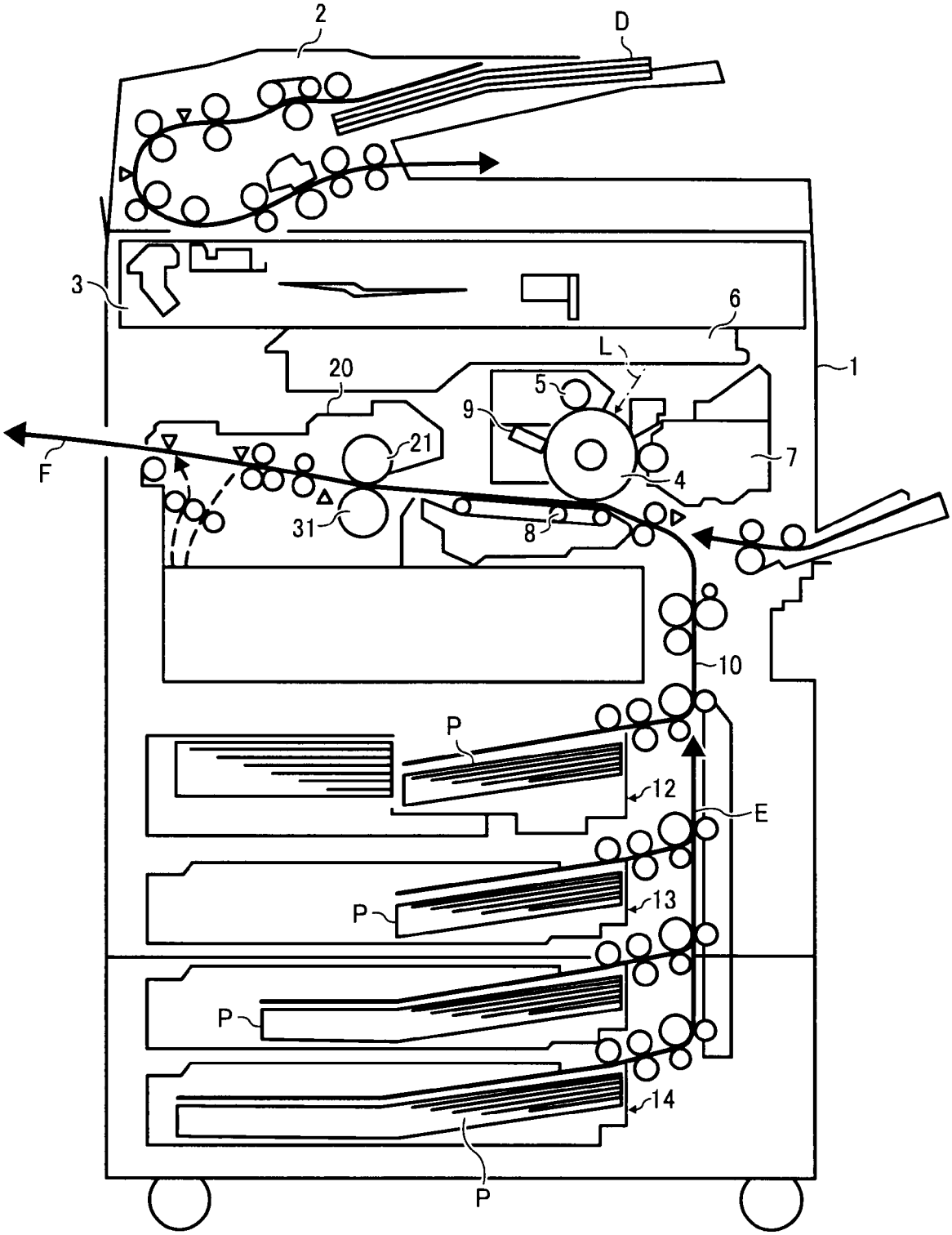
FIG. 1 is a schematic cross-sectional view illustrating an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, particularly to FIG. 1, description will be given of an embodiment of the present invention.

A basic configuration of an image forming apparatus to which the present invention is applied will be made clear from the following description. FIG. 1 is a schematic cross-sectional view illustrating an image forming apparatus according to an embodiment of the present invention. The image forming apparatus illustrated herein includes an image forming apparatus body 1 and an automatic sheet-feeding device 2 provided on an upper portion of the image forming apparatus body 1. The image forming apparatus body 1 includes a scanning device 3, a photoconductor 4, a charging device 5, an optical writing unit 6, a development device 7, a transfer device 8, a cleaning device 9, a conveyance path 10, sheet-feeding units 12 to 14, and a fixing device 20 including a fixing film 21, a pressure roller 31, and so forth.

On a sheet table of the automatic sheet-feeding device 2, one or a plurality of documents D is placed by an operator. Then, upon pressing a print key (not illustrated) provided to the image forming apparatus, the image of the topmost document D is scanned by the scanning device 3.

Meanwhile, inside the image forming apparatus body 1, the drum-shaped photoconductor 4, which is an example of a rotatably supported image carrying member, is driven and rotated in the clockwise direction in FIG. 1. In this process, a surface of the photoconductor 4 is charged to a predetermined polarity by the charging device 5. Further, the optical writing unit 6 emits a laser beam L optically modulated in accordance with the information of the image scanned by the scanning device 3. Then, the charged surface of the photoconductor 4 is exposed to the laser beam L, and an electrostatic latent image is formed on the surface of the photoconductor 4. The electrostatic latent image is then developed into a visible toner image with powdery toner when the electrostatic latent image passes through the development device 7. Then, the transfer device 8 facing the photoconductor 4 transfers the toner image onto a recording medium P fed and conveyed to the position between the photoconductor 4 and the transfer device 8 as described later. After the process of transferring the toner image, the cleaning device 9 cleans the surface of the photoconductor 4.

The recording medium P constituted as a transfer sheet or a resin sheet, for example, is stacked on the sheet-feeding units 12 to 14 provided in a lower part of the image forming apparatus body 1. The topmost recording medium P is fed in directions indicated by arrows E and F, and is conveyed to the transfer device 8 through the conveyance path 10. Then, the toner image formed on the photoconductor 4 is transferred onto a surface of the recording medium P. The recording medium P to which the toner image is transferred passes through the fixing device 20, in which the unfixed toner image is fixed on the recording medium P by the action of heat and pressure applied thereon.

Subsequently, with reference to FIGS. 2 to 5, detailed description will be made of a configuration and operation of the fixing device 20 provided in the image forming apparatus body 1.

Figure 2:
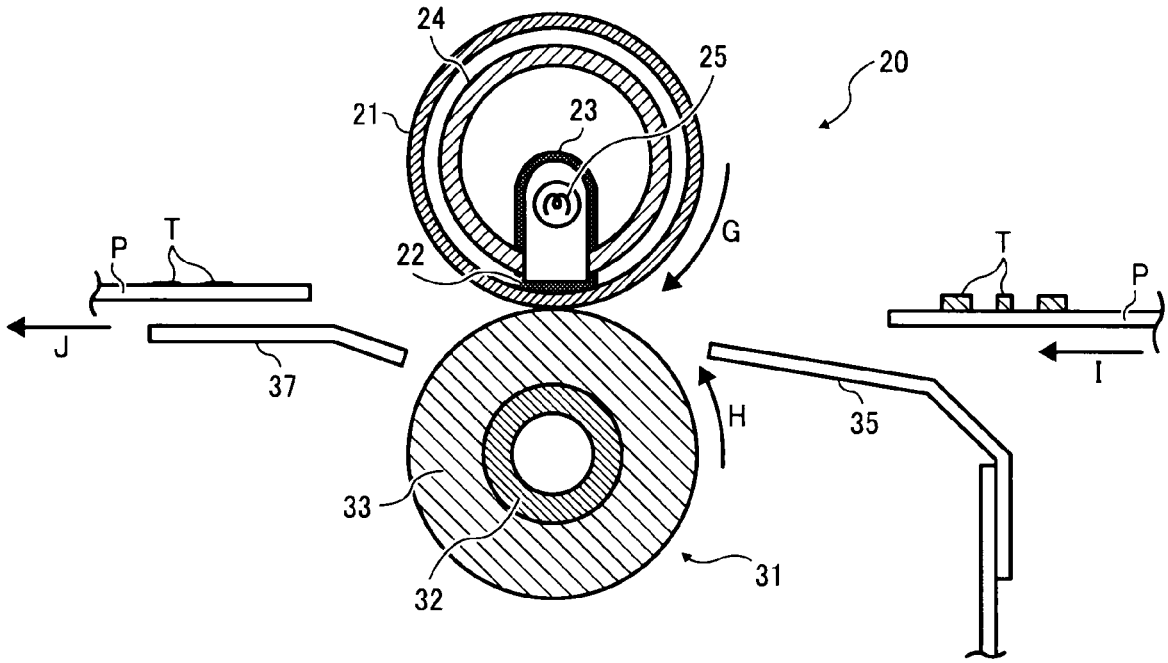
FIG. 2 is a configuration diagram illustrating a fixing device according to an embodiment of the present invention.
Figure 3:
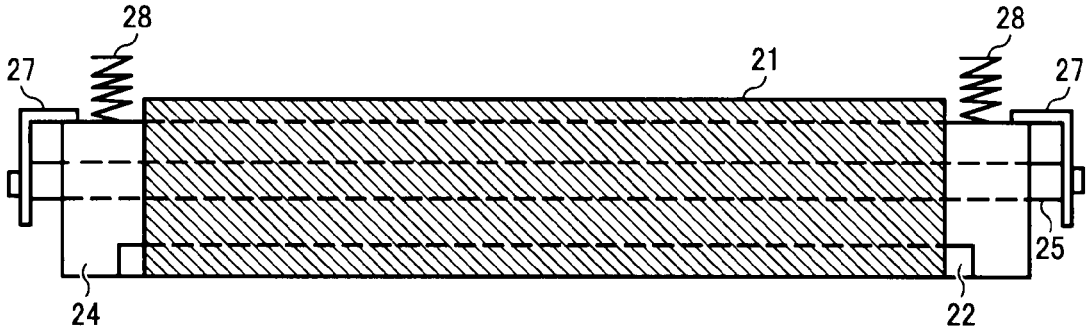
FIG. 3 is a partial view of the fixing device, as viewed along the width direction thereof.
Figure 4:
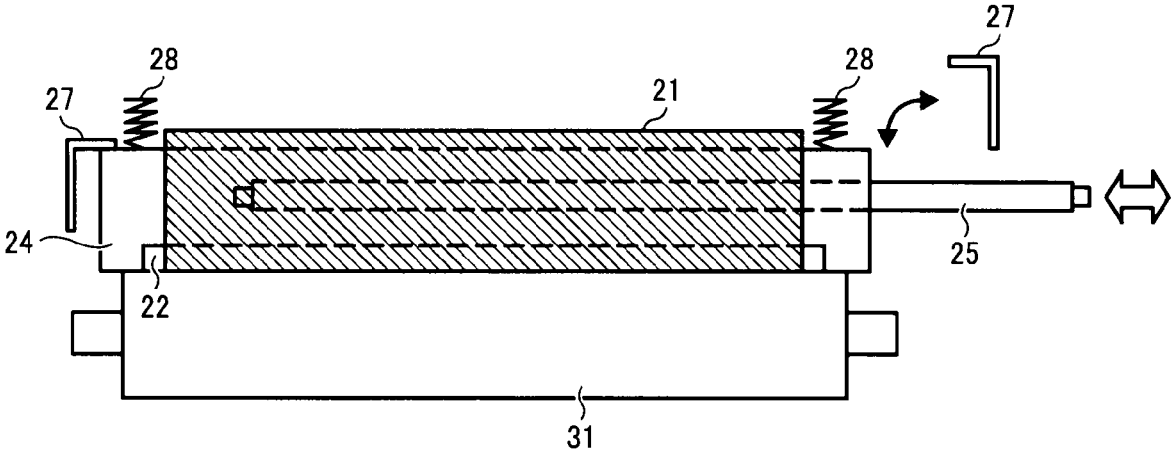
FIG. 4 is a diagram illustrating a state in which a heater serving as a heating device is inserted in and removed from the fixing member.
Figure 5:
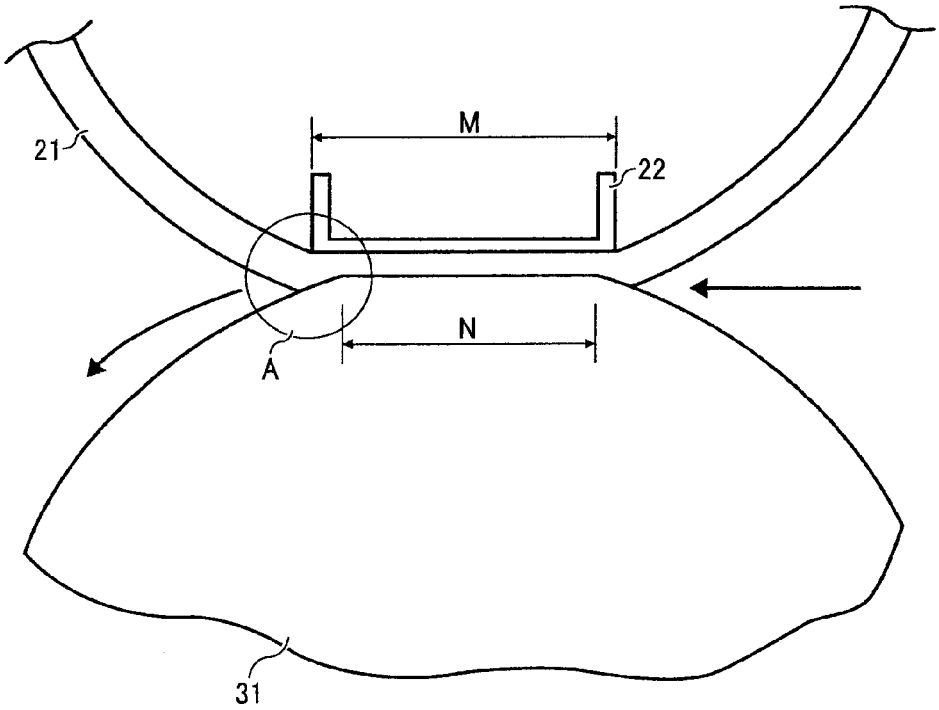
FIG. 5 is an enlarged partial view illustrating the vicinity of a nip portion in the fixing device.

FIG. 2 is a configuration diagram illustrating the fixing device 20. FIG. 3 is a partial view of the fixing device 20, as viewed along the width direction thereof. FIG. 4 is a diagram illustrating a state in which an infrared heater 25 serving as a heating device is inserted in and removed from the fixing device 20. FIG. 5 is an enlarged partial view illustrating the vicinity of a nip portion in the fixing device 20.

In FIGS. 2 to 4, the fixing device 20 includes the fixing film 21, a heating plate 22, a reflecting plate 23, a holding member 24, the heater 25, holders 27, and compression springs 28.

The fixing device 20 further includes the pressure roller 31 formed by a core bar 32 and an elastic layer 33, and guide plates 35 and 37.

The fixing film 21 is a thin, flexible, endless film rotated in the direction indicated by an arrow G, i.e., the clockwise direction in FIG. 2. The material forming the fixing film 21 includes polyimide, polyamide, a fluororesin, a metal, and so forth. To ensure releasability, i.e., the removability of the fixing film 21 from the toner (i.e., a toner image T in FIG. 2), the outer circumferential surface of the fixing film 21 may be formed with a release layer formed of PFA (tetrafluoroethylene-perfluoroalkylvinylether copolymer resin), polyimide, polyetherimide, PES (polyethersulfide), and so forth. If a fixing film having a low heat capacity is used as the fixing film 21, an on-demand-type fixing device having a substantially short rise time can be provided.

The interior of the fixing film 21, i.e., the space encompassed by the inner circumferential surface of the fixing film 21, is provided with a heating device formed as the heater 25 and a contact member formed as the heating plate 22. The opposite end portions of the heating plate 22 are fixed to side plates (not illustrated) of the fixing device 20 via the holding member 24. The heating plate 22 presses the fixing film 21 to form a nip portion between the fixing film 21 and the pressure roller 31.

The heating plate 22 serving as the contact member is formed by a metal plate or a plate formed of a ceramic or a polyimide resin and having a thickness of approximately 0.1 millimeters. The heating plate 22 is heated by the radiant heat from the heater 25, and comes into contact with the pressure roller 31 via the fixing film 21 to form a desired nip portion.

In the present embodiment, a facing surface of the heating plate 22 facing the pressure roller 31 is formed into a flat surface. Accordingly, the shape of the nip portion becomes substantially parallel to the image-formed surface of the recording medium P, and thus the close contact between the fixing film 21 and the recording medium P is enhanced. As a result, the fixing performance is improved, and such trouble as a curl or fold formed in the recording medium P passing through the nip portion is reduced. Further, the curvature of the fixing film 21 is increased at the exit side of the nip portion. Therefore, the recording medium P having passed through the nip portion can be easily separated from the fixing film 21.

The heater 25 serving as the heating device includes the infrared heater such as a carbon heater and a halogen heater. As described later, the opposite end portions of the heater 25 are attachably and detachably fixed to the side plates (not illustrated) of the fixing device 20 via the holders 27 and the holding member 24. The heater 25, the output of which is controlled by a power supply portion (not illustrated) of the image forming apparatus body 1, heats the heating plate 22. Then, the heating plate 22 heats the fixing film 21, and the heat from the surface of the fixing film 21 is applied to the toner image T carried on the recording medium P. The output control of the heater 25 is performed on the basis of the result of detection of the temperature of the surface of the fixing film 21 performed by a temperature sensor (not illustrated) provided to face the surface of the fixing film 21. Due to such output control of the heater 25, the temperature of the fixing film 21, i.e., the fixing temperature can be set to a desired temperature.

In the present embodiment, the heater 25 serving as the heating device is provided to be insertable in and removable from the fixing device 20 in a state in which the heating plate 22 is in contact with the pressure roller 31 via the fixing film 21. This configuration will be described in detail later with reference to FIG. 4.

If the carbon heater is used as the heater 25, the degree of freedom of the ON-OFF control is increased, as compared with a case using the halogen heater. Specifically, disconnection does not occur in spite of repeated performance of the control of turning off the electricity before the duty cycle of the heater 25 reaches 100 percent. Therefore, a decrease in output over time is reduced.

Further, in the use of the carbon heater, it is preferred to form the carbon heater into an optimal shape such that the amount of the radiant heat radiated in the directions opposite to the heating plate 22, i.e., the vertical directions in FIG. 2 is greater than the amount of the radiant heat radiated in the directions perpendicular to the vertical directions, i.e., the horizontal directions in FIG. 2. With this configuration, the heat generated by the heater 25 can be focused on the heating plate 22. As a result, the heating efficiency of the heating plate 22 can be enhanced.

The reflecting plate 23 serving as a reflecting member is provided on the side opposite across the heater 25 to the side facing the heating plate 22, i.e., on the side above the heater 25 in FIG. 2. The reflecting plate 23, which is formed of aluminum finished with a mirror surface, reflects infrared light emitted from the heater 25. Most of the infrared light reflected by the reflecting plate 23 is incident on the heating plate 22. Therefore, the heating efficiency of the heating plate 22 is enhanced.

In the present embodiment, the reflecting plate 23 is provided at a position apart from the heater 25. Alternatively, a part of a glass tube of the heater 25 on the opposite side to the side facing the heating plate 22 may be subjected to gold plating or aluminum vapor deposition. In this case, the plated gold or the vapor-deposited aluminum on the glass functions as the reflecting member. Therefore, the heating efficiency of the heating plate 22 is enhanced also in this case.

Further, a facing surface of the heating plate 22 facing the heater 25 may be provided with an absorption member for absorbing the infrared light. Specifically, the facing surface of the heating plate 22 may be coated with black paint. With this configuration, the infrared absorptance of the heating plate 22 is increased, and the heating efficiency of the heating plate 22 is enhanced.

In FIG. 3, the holding member 24 integrally holds the heating plate 22, the heater 25, and the reflecting plate 23. The holding member 24 is formed of a heat-resistant resin material, and the opposite end portions of the holding member 24 are respectively supported by the side plates (not illustrated) of the fixing device 20.

In particular, the heater 25 is held by the holding member 24 via the holders 27 each serving as a second holding member. Specifically, the holders 27 are respectively fixed by screws to the opposite end portions of the holding member 24 in the width direction thereof. Each of the holders 27 is formed with a hole which is engaged with a corresponding end portion of the heater 25. With this configuration, it is possible to remove only the heater 25 from the holding member 24, i.e., from the fixing device 20 by detaching one of the holders 27 from the holding member 24.

Further, each of the opposite end portions of the holding member 24 in the width direction thereof is provided with the compression spring 28. Accordingly, the heating plate 22 serving as the contact member is biased toward the pressure roller 31 to form the desired nip portion. The pressure roller 31 is rotatably provided at fixed positions on the side plates (not illustrated) of the fixing device 20 via bearings (not illustrated). Further, the pressure roller 31 is driven and rotated in a predetermined direction by a drive motor (not illustrated). Meanwhile, the fixing film 21 is driven in the direction indicated by the arrow G in FIG. 2 by the frictional force acting between the fixing film 21 and the pressure roller 31.

With the configuration described above, a drive mechanism and a pressure mechanism of the fixing device 20 can be simplified. Further, in FIG. 2, the holding member 24 is formed to guide the fixing film 21. That is, the holding member 24 is formed into a circular shape to maintain the circular shape of the flexible fixing film 21 to a certain degree. Accordingly, the deterioration and damage of the fixing film 21 due to the deformation thereof can be suppressed.

In FIG. 2, the pressure roller 31 serving as the pressure member is formed by the core bar 32 covered with the elastic layer 33. The elastic layer 33 of the pressure roller 31 is formed of a material such as a fluororubber, a silicone rubber, and a foamable silicone rubber. The outer circumferential surface of the elastic layer 33 may be provided with a thin tube-like release layer formed of PFA or the like. The pressure roller 31 comes into pressure contact with the fixing film 21 to form therebetween the desired nip portion. Further, the pressure roller 31 is driven and rotated by the drive mechanism (not illustrated) in the direction indicated by an arrow H, i.e., the counterclockwise direction in FIG. 2.

The entrance side of the contact portion, i.e., the nip portion formed between the fixing film 21 and the pressure roller 31 is provided with the guide plate 35 serving as an entrance guide plate for guiding the recording medium P conveyed to the nip portion. Meanwhile, the exit side of the nip portion is provided with the guide plate 37 serving as an exit guide plate for guiding the recording medium P sent out from the nip portion. The guide plates 35 and 37 are both fixedly provided to the frame, i.e., the housing of the fixing device 20.

The fixing device 20 configured as described above operates as follows. Upon turning on of a power supply switch (not illustrated) of the image forming apparatus body 1, electricity is supplied to the heater 25, and the pressure roller 31 is driven and rotated in the counterclockwise direction in FIG. 2. As a result, the fixing film 21 is also driven and rotated in the direction indicated by the arrow G in FIG. 2 by the frictional force acting between the fixing film 21 and the pressure roller 31.

Thereafter, the recording medium P is fed and conveyed from one of the sheet-feeding units 12 to 14, and toner image T formed on the photoconductor 4 is transferred to the recording medium P. The recording medium P carrying thereon the toner image T is then conveyed in the direction indicated by an arrow I in FIG. 2, while being guided by the guide plate 35. Then, the recording medium P is nipped by the nip portion formed between the fixing film 21 and the pressure roller 31, which are in the pressure contact state.

Then, the toner image T is fixed to the surface of the recording medium P by the heat applied by the fixing film 21 heated by the heating plate 22 and the pressing force applied by the pressure roller 31, the heating plate 22, and the fixing film 21. Thereafter, the recording medium P discharged from the nip portion is conveyed in the direction indicated by an arrow J, while being guided by the guide plate 37.

In the fixing device 20 configured as described above, the heater 25 can be inserted in and removed from the fixing device 20 in the state in which the heating plate 22 is in contact with the pressure roller 31 via the fixing film 21, with no need to release the pressure acting between the fixing film 21, the heating plate 22, and the pressure roller 31. Specifically, the heater 25 is inserted in the fixing device 20 after the attachment of the holder 27 to the holding member 24, and is removed from the fixing device 20 after the detachment of the holder 27 from the holding member 24.

More specifically, to remove the heater 25 from the fixing device 20 for maintenance of the heater 25, the screw is first loosened to detach one of the holders 27 from the holding member 24. Then, the heater 25 is withdrawn from the side of the holding member 24 from which the holder 27 has been detached, toward the extending direction of the heater 25 to the right side in FIG. 4. To attach the new or repaired heater 25 to the fixing device 20, an operation inverse to the above-described removal operation is preformed.

As described above, the fixing device 20 according to the present embodiment is configured to have a substantially short rise time. Further, the fixing device 20 can improve the exchangeability, i.e., the maintenance performance of the relatively frequently exchanged heater 25 with the relatively simple configuration and without the mechanism for releasing the pressure acting between the heating plate 22, the fixing film 21, and the pressure roller 31.

Further, in the present embodiment, the heater 25 serving as the heating device is provided apart from the heating plate 22 serving as the contact member, as illustrated in FIG. 2. That is, the heater 25 is provided with a certain amount of gap formed between the heater 25 and the heating plate 22. Accordingly, even if the fixing device 20 is transported in the state in which the heating plate 22 is in pressure contact with the pressure roller 31 via the fixing film 21, for example, the vibration directly transmitted to the heater 25 from the heating plate 22 and so forth can be reduced. As a result, the damage on the heater 25 can be suppressed. Further, even if the unjamming operation is performed to remove the recording medium P jammed at the position of the fixing device 20 in the state in which the heating plate 22 is in pressure contact with the pressure roller 31 via the fixing film 21, for example, the impact of the unjamming operation directly transmitted to the heater 25 from the nip portion can be reduced. As a result, the damage on the heater 25 can be suppressed.

Further, in the present embodiment, a length M of the heating plate 22 in the conveyance direction of the recording medium P is set to be greater than a nip width N of the nip portion. That is, the relationship M>N is established.

Accordingly, in an area A at the exit side of the nip portion in FIG. 5, the fixing film 21 is deformed according to the shape of the pressure roller 31 to protrude toward the pressure roller 31. After the fixing process, therefore, the recording medium P is sent out in a direction of separating from the fixing film 21. That is, the conveyance performance and the releasability of the recording medium P can be improved in the sending out thereof from the nip portion.

In the fixing device 20 according to the present embodiment, the heating plate 22 and the fixing film 21 slidingly contact with each other in the pressure contact state. Thus, a reduction in friction between the heating plate 22 and the fixing film 21 is required.

Figure 6:
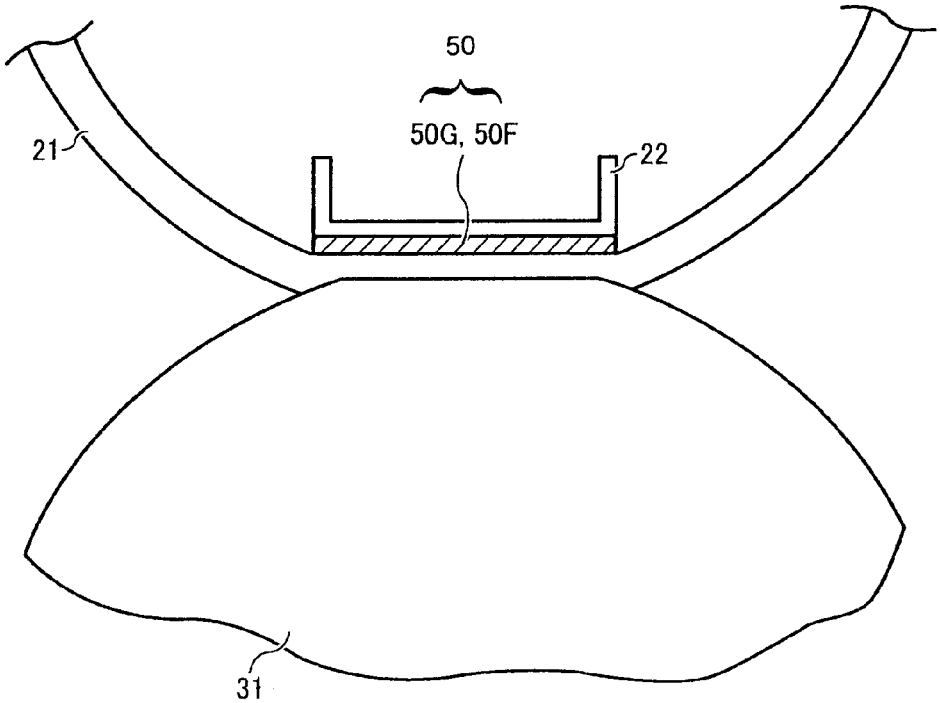
FIG. 6 is an enlarged partial view illustrating the vicinity of a nip portion in another example of the fixing device according to the embodiment.

In an example of the present embodiment, therefore, a low friction member 50 is provided between the heating plate 22 and the fixing film 21, as illustrated in FIG. 6. With the low friction member 50 thus provided between the heating plate 22 and the fixing film 21, it is possible to reduce the coefficient of friction between the heating plate 22 and the fixing film 21 without directly affecting the characteristics of the heater 25.

As illustrated in FIG. 6, a grease 50G, a fluororesin layer 50F, and so forth can be used as the low friction member 50.

If a heat-resistant grease is used as the grease 50G, a change in the characteristics of the grease 50G can be suppressed in spite of the heat applied by the heater 25 and frictional heat generated by the sliding movement.

Further, if the grease 50G or the fluororesin layer 50F serving as the low friction member 50 is mixed with thermal conductivity improving particles (not illustrated) such as carbon particles, for example, it is possible not only to reduce the coefficient of friction but also to improve the thermal conductivity.

Figure 7:
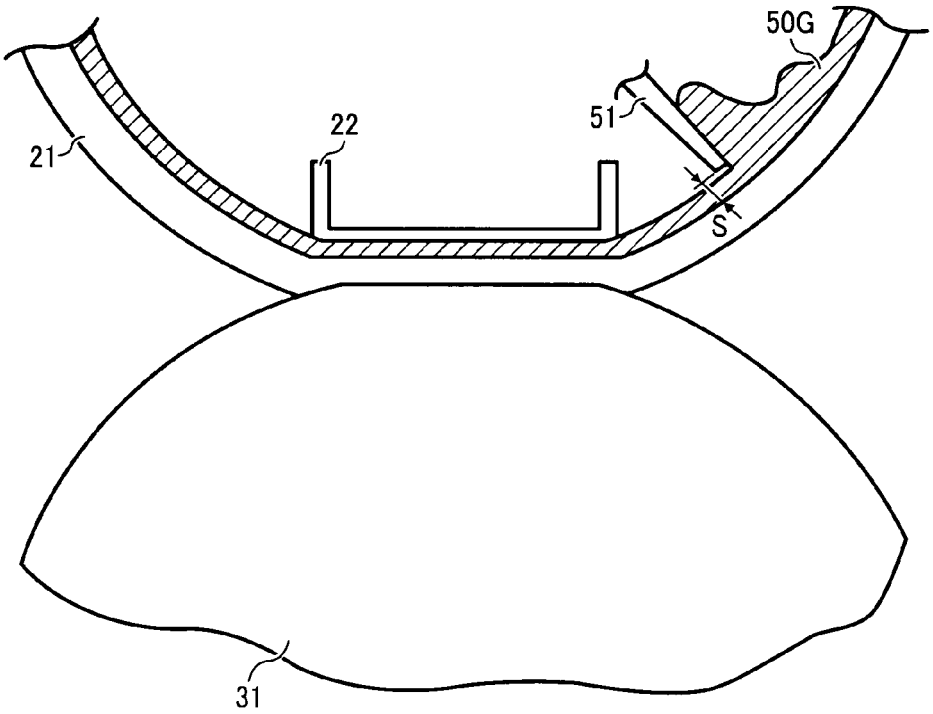
FIG. 7 is an enlarged partial view illustrating the vicinity of a nip portion in a modified example of the fixing device illustrated in FIG. 6.

FIG. 7 is a diagram illustrating a configuration using the grease 50G as the low friction member 50 and a blade 51 as a mechanism for controlling the amount of the grease 50G to be applied. If the blade 51 is set to have a gap S between the leading end thereof and the fixing film 21, the amount of the grease 50G to be applied can be equalized in accordance with the size of the gap S.

Figure 8:
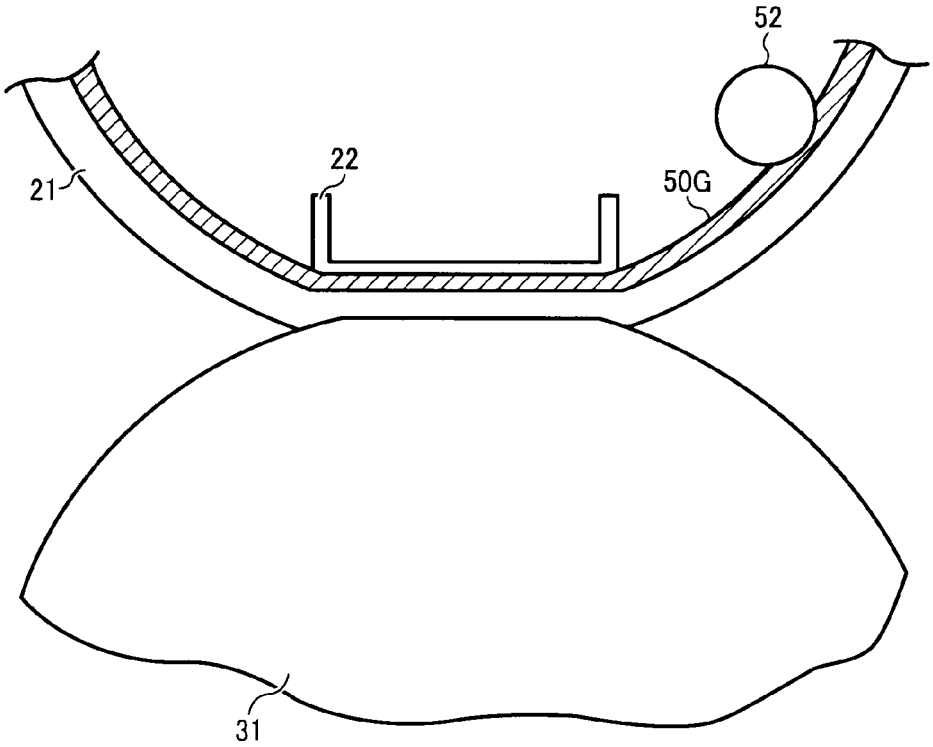
FIG. 8 is an enlarged partial view illustrating the vicinity of a nip portion in another modified example of the fixing device illustrated in FIG. 6.

FIG. 8 is a diagram illustrating a configuration using the grease 50G as the low friction member 50 and an application roller 52 as the mechanism for controlling the amount of the grease 50G to be applied. With the application roller 52 thus provided, the amount of the grease 50G to be applied can be more accurately and easily equalized.

In the fixing device 20 according to the present embodiment, an increase in the thermal conductivity from the heating plate 22 to the fixing film 21 is required so as not to impair the on-demand function of the fixing device 20.

Figure 9:
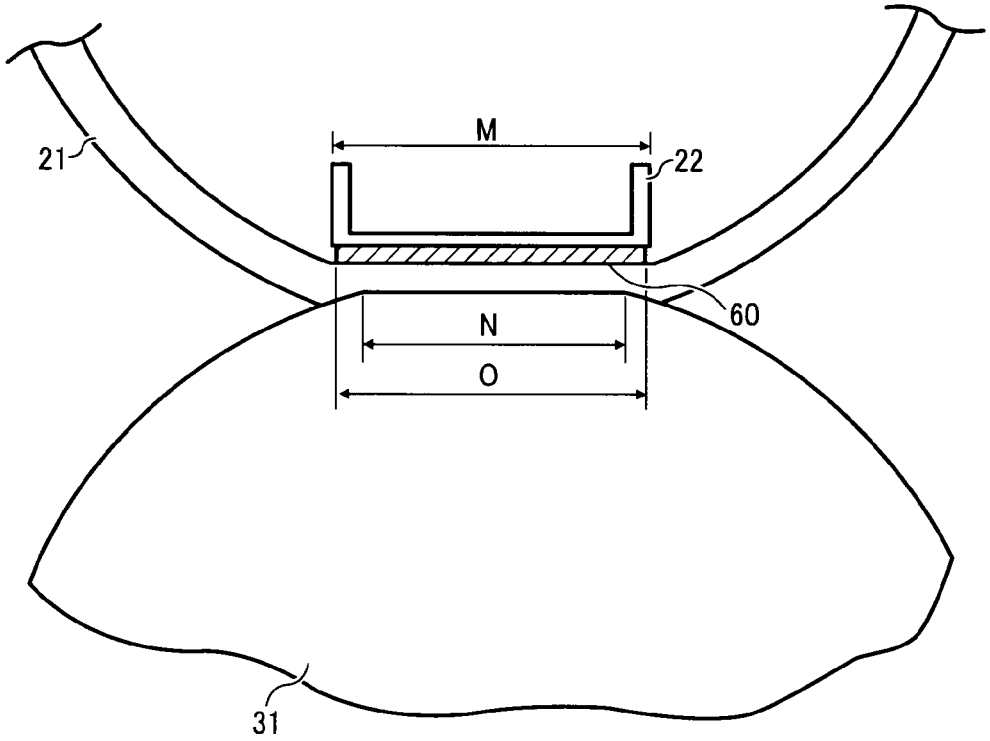
FIG. 9 is an enlarged partial view illustrating the vicinity of a nip portion in another example of the fixing device according to the embodiment.

In an example of the present embodiment, therefore, a thermal conductivity improving member 60 is provided between the heating plate 22 and the fixing film 21, as illustrated in FIG. 9. With the thermal conductivity improving member 60 thus provided between the heating plate 22 and the fixing film 21, it is possible to increase the thermal conductivity without directly affecting the characteristics of the heater 25.

A carbon or aluminum layer coating the surface of the heating plate 22 in sliding contact with the fixing film 21 can be used as the thermal conductivity improving member 60.

In this case, as illustrated in FIG. 9, a length O of the thermal conductivity improving member 60 in the conveyance direction of the recording medium P is set to be at least equal to or greater than the nip width N of the nip portion formed by the fixing film 21 and the heating plate 22. With this configuration, the thermal conductivity at the nip portion can be increased.

Figure 10:
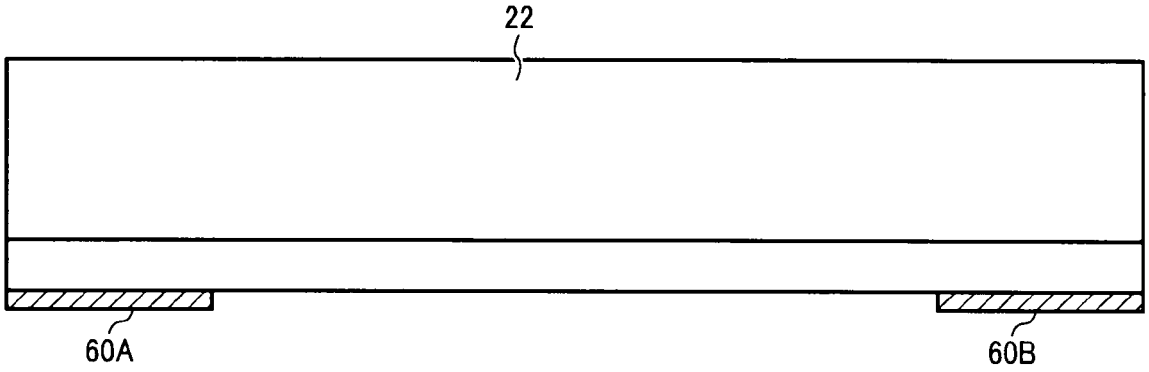
FIG. 10 is an explanatory diagram illustrating a modified example of the fixing device illustrated in FIG. 9.

In FIG. 10, thermal conductivity improving members 60A and 60B are added only to end portions of the heating plate 22 in the longitudinal direction thereof, i.e., the direction perpendicular to the conveyance direction. With this configuration, it is possible to prevent a reduction in the fixing temperature due to the escape of heat from the opposite end portions of the heating plate 22. Accordingly, a homogeneous temperature distribution is obtained, and uneven fixation of the toner image can be suppressed.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

The invention claimed is:

1. An image forming apparatus comprising:

an image forming mechanism that forms a toner image on a recording medium; and a fixing device that fixes the toner image on the recording medium, the fixing device including:

a fixing film configured to come into contact with the recording medium, a pressure member configured to come into pressure contact with the fixing film, a contact member configured to come into pressure contact with the pressure member via the fixing film to form, between the fixing film and the pressure member, a nip portion through which the recording medium is passed, a heating device that heats the fixing film via the contact member, the heating device being disposed such that there is a gap between the heating device and the contact member, a holding member that holds the contact member and the heating device, the holding member having a circle shape formed to guide the fixing film disposed surrounding the holding member, a low friction member disposed between the fixing film and the contact member, the low friction member being grease, and a grease application amount control mechanism that controls the amount of the grease to be applied to an inner surface of the fixing film, the grease application amount control mechanism including one of a blade and an application roller.

2. The image forming apparatus according to claim 1, further comprising a reflecting member disposed on a side of the heating device opposite a side proximate to the contact member.

3. The image forming apparatus as described in claim 1, wherein the grease application amount control mechanism includes the blade, which is disposed near the fixing film with a gap formed between a leading end thereof and the inner surface of the fixing film.

4. The image forming apparatus as described in claim 1, wherein the grease application amount control mechanism includes the application roller, which rotates in contact with the inner surface of the fixing film.

5. A fixing device for fixing a toner image on a recording medium, the fixing device comprising:

a fixing film configured to come into contact with the recording medium;

a pressure member configured to come into pressure contact with the fixing film;

a contact member configured to come into pressure contact with the pressure member via the fixing film to form, between the fixing film and the pressure member, a nip portion through which the recording medium is passed;

a heating device that heats the fixing film via the contact member, the heating device being disposed such that there is a gap between the heating device and the contact member;

a holding member that holds the contact member and the heating device, the holding member having a circle shape formed to guide the fixing film disposed surrounding the holding member;

a low friction member disposed between the fixing film and the contact member, the low friction member being grease; and a grease application amount control mechanism that controls the amount of the grease to be applied to an inner surface of the fixing film, the grease application amount control mechanism including one of a blade and an application roller.

6. The fixing device as described in claim 5, wherein the grease is heat resistant.

7. The fixing device as described in claim 5, wherein the grease is mixed with thermal conductivity improving particles.

8. The fixing device as described in claim 7, wherein the thermal conductivity improving particles comprise carbon particles.

9. The fixing device as described in claim 5, wherein the grease application amount control mechanism includes the blade, which is disposed near the fixing film with a gap formed between a leading end thereof and the inner surface of the fixing film.

10. The fixing device as described in claim 5, wherein the grease application amount control mechanism includes the application roller, which rotates in contact with the inner surface of the fixing film.

11. The fixing device as described in claim 5, further comprising a thermal conductivity improving member that includes a carbon layer coating a surface of the contact member in sliding contact with the fixing film.

12. The fixing device as described in claim 5, further comprising a thermal conductivity improving member that includes an aluminum layer coating a surface of the contact member in sliding contact with the fixing film.

13. The fixing device as described in claim 5, further comprising a thermal conductivity improving member disposed on a surface of the contact member facing the pressure member, the thermal conductivity improving member being at least as wide as a width of the nip portion.

14. The fixing device as described in claim 5, further comprising a thermal conductivity improving member disposed only on each end portion of the contact member in a width direction of the contact member.

15. The fixing device according to claim 5, further comprising a reflecting member disposed on a side of the heating device opposite a side proximate to the contact member.

16. A method of fixing a toner image on a recording medium, comprising steps of:

providing a low friction member between a fixing film and a contact member, the low friction member being grease;

controlling the amount of grease to be applied to an inner surface of the fixing film with a grease application amount control mechanism, the grease application amount control mechanism including one of a blade and an application roller;

heating the fixing film with a heating device via the contact member, the heating device being disposed such that there is a gap between the heating device and the contact member;

providing a holding member that holds the contact member and the heating device, the holding member having a circle shape formed to guide the fixing film disposed surrounding the holding member; and providing pressure to contact the contact member with the fixing film to fix the toner image.

17. The image forming apparatus according to claim 2, wherein a surface of the reflecting member includes aluminum formed with a mirror finish such that the surface of the reflecting member reflects infrared light emitted by the heating device.

18. The method of fixing a toner image as described in claim 16, wherein the grease application amount control mechanism includes the blade, which is disposed near the fixing film with a gap formed between a leading end thereof and the inner surface of the fixing film.

19. The method of fixing a toner image as described in claim 16, wherein the grease application amount control mechanism includes the application roller, which rotates in contact with the inner surface of the fixing film.

* * * * *